US011411327B1

(12) United States Patent
Wang et al.

(10) Patent No.: US 11,411,327 B1
(45) Date of Patent: Aug. 9, 2022

(54) DUAL-BEAM ANTENNA AND HYBRID ANTENNA

(71) Applicants: ROSENBERGER TECHNOLOGIES CO., LTD., Suzhou (CN); ROSENBERGER TECHNOLOGIES LLC, Budd Lake, NJ (US)

(72) Inventors: Shengguang Wang, Suzhou (CN); Zhongcao Yang, Suzhou (CN); Guoqun Chen, Suzhou (CN)

(73) Assignees: ROSENBERGER TECHNOLOGIES CO., LTD., Suzhou (CN); ROSENBERGER TECHNOLOGIES LLC, Budd Lake, NJ (US)

( * ) Notice: Subject to any disclaimer, the term of this patent is extended or adjusted under 35 U.S.C. 154(b) by 0 days.

(21) Appl. No.: 17/383,158

(22) Filed: Jul. 22, 2021

(30) Foreign Application Priority Data

Mar. 15, 2021 (CN) ..... 202110276563.3

(51) Int. Cl.

| | |
|---|---|
| ***H01Q 1/24*** | (2006.01) |
| ***H01Q 25/02*** | (2006.01) |
| ***H01Q 21/06*** | (2006.01) |
| ***H01Q 3/26*** | (2006.01) |

(52) U.S. Cl.
CPC ..... *H01Q 25/02* (2013.01); *H01Q 3/267* (2013.01); *H01Q 21/061* (2013.01); *H01Q 1/246* (2013.01)

(58) Field of Classification Search
CPC ..... H01Q 25/02; H01Q 3/267; H01Q 21/061; H01Q 1/246
See application file for complete search history.

(56) References Cited

U.S. PATENT DOCUMENTS

| | | | | |
|---|---|---|---|---|
| 2018/0026380 | A1* | 1/2018 | Powell | H01Q 21/26 343/893 |
| 2020/0321697 | A1* | 10/2020 | Zimmerman | H01Q 3/30 |
| 2020/0321700 | A1* | 10/2020 | Wu | H01Q 1/405 |
| 2021/0006300 | A1* | 1/2021 | Bisiules | H04L 5/14 |
| 2021/0021019 | A1* | 1/2021 | Hou | H01Q 21/26 |

* cited by examiner

*Primary Examiner* — Awat M Salih
(74) *Attorney, Agent, or Firm* — Anova Law Group, PLLC

(57) ABSTRACT

A dual-beam antenna includes an element array and a feed network. The element array includes a first element set and a second element set. The first element set includes at least three first elements arranged in a row. The second element set includes at least three second elements arranged in a row. The at least three first elements of the first element set and the at least three second elements of the second element set are independent of each other. The feed network includes a first feed network and a second feed network. The first feed network includes a first cable set and a first power divider. The second feed network includes a second cable set and a second power divider.

20 Claims, 8 Drawing Sheets

DUAL-BEAM ANTENNA AND HYBRID ANTENNA

CROSS-REFERENCE TO RELATED APPLICATIONS

This application claims priority to Chinese Application No. 202110276563.3, filed on Mar. 15, 2021, the entire contents of which and its priority applications, if any, is incorporated herein by reference.

TECHNICAL FIELD

The present disclosure generally relates to the communication field and, more particularly, to a dual-beam antenna and a related hybrid antenna.

BACKGROUND

Mobile communication has become an essential tool in the modern world as an important channel for people to communicate, entertain, and obtain information. Mobile communication has a broad user basis and a wide range of applications. To satisfy user application requirements, a plurality of communication systems, such as 2G, 3G, 4G, WLAN systems, etc., are included in the mobile communication field. Different communication frequency bands are assigned to different communication systems. Therefbre, an antenna that covers a plurality of frequency bands simultaneously can improve utilization rates of site resources of a base station, the spectrum resources, and the environmental resources and can reduce resource waste.

SUMMARY

Embodiments of the present disclosure provide a dual-beam antenna including an element array and a feed network. The element array includes a first element set and a second element set. The first element set includes at least three first elements arranged in a row. The second element set includes three second elements arranged in a row. The at least three first elements of the first element set and the at least three second elements of the second element set are independent of each other. The feed network includes a first feed network and a second feed network. The first feed network includes a first cable set and a first power divider. The first power divider is connected to each first element of the first element set through the corresponding first cable set. The first cable set and/or the first power divider is configured to adjust phases of a signal for forming a first beam in the at least three first elements. The second feed network includes a second cable set and a second power divider. The second power divider is connected to each second element of the second element set through the corresponding second cable set. The second cable set and/or the second power divider is configured to adjust phases of a signal for forming a second beam in the at least three second elements.

Embodiments of the present disclosure provide a hybrid antenna including a first antenna and a second antenna. The first dual-beam antenna includes an element array and a feed network. The element array includes a first element set and a second element set. The first element set includes three first elements arranged in a row. The second element set includes three second elements arranged in a row. The at least three first elements of the first element set and the at least three second elements of the second element set are independent of each other. The feed network includes a first feed network and a second feed network. The first feed network includes a first cable set and a first power divider. The first power divider is connected to each first element of the first element set through the corresponding first cable set. The first cable set and/or the first power divider are configured to adjust phases of a signal for forming a first beam in the at least three first elements. The second feed network includes a second cable set and a second power divider. The second power divider is connected to each second element of the second element set through the corresponding second cable set. The second cable set and/or the second power divider is configured to adjust phases of a signal for forming a second beam in the at least three second elements. The second antenna includes a low-frequency element array and/or a high-frequency element array.

Embodiments of the present disclosure provide a hybrid antenna including a first antenna, a second antenna and a third antenna. The first dual-beam antenna includes an element array and a feed network. The element array includes a first element set and a second element set. The first element set includes three first elements arranged in a row. The second element set includes three second elements arranged in a row. The at least three first elements of the first element set and the at least three second elements of the second element set are independent of each other. The feed network includes a first feed network and a second feed network. The first feed network includes a first cable set and a first power divider. The first power divider is connected to each first element of the first element set through the corresponding first cable set. The first cable set and/or the first power divider is configured to adjust phases of a signal for forming a first beam in the at least three first elements. The second feed network includes a second cable set and a second power divider. The second power divider is connected to each second element of the second element set through the corresponding second cable set. The second cable set and/or the second power divider is configured to adjust phases of a signal for forming a second beam in the at least three second elements. The second antenna includes a low-frequency element array. The third antenna includes a high-frequency element array.

In the present disclosure, the other features, characteristics, advantages, and benefits will become apparent through the detailed description in conjunction with the drawings.

DETAILED DESCRIPTION OF THE EMBODIMENTS

Embodiments of the present disclosure are described in connection with a part of the accompanying drawings of the present disclosure. The accompanying drawings illustrate embodiments of the present disclosure by examples. Exemplary embodiments are not intended to exhaust all embodiments of the present disclosure. Without departing from the scope of the present disclosure, other embodiments may be used, or structural or logical modifications may be performed. Therefore, the following description is not restrictive, and the scope of the invention is defined by appended claims.

Figure 1:
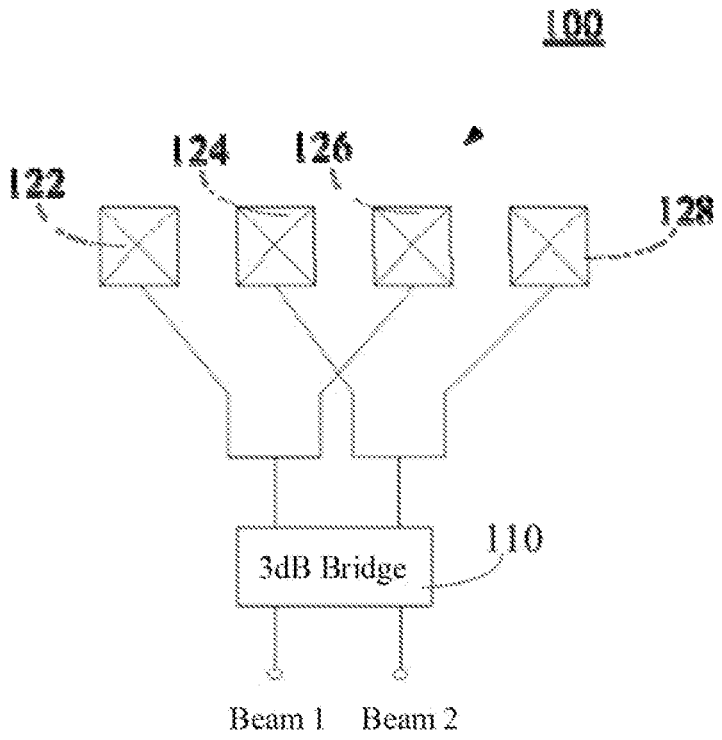
FIG. 1 is a schematic diagram showing a dual-beam antenna 100 realized by using the principle of Butler matrix.

As shown in FIG. 1, a dual-beam antenna implemented by a traditional Butler matrix principle uses a 3 dB bridge 110 to realize a dual-beam. In some embodiments, two input terminals of the 3 dB bridge 110 may be configured to input electrical signals for forming beam 1 and beam 2. After the electrical signals are processed by the 3 dB bridge 110, corresponding electrical signals may be formed at output terminals. The corresponding electrical signals may be output to elements (the element, as used herein, may refer to a radiator) 122, 124, 126, and 128. In some embodiments, as shown in FIG. 1, phases of an electrical signal for forming beam 1 at the four elements 122, 124, 126, and 128 includes −3 Δ P, −2 Δ P. −Δ P, and 0°, phases of an electrical signal for forming beam 2 at the four elements 122, 124, 126, and 128 includes 0°, −Δ P, −2 Δ P, and −3 Δ P, and Δ P can only be 90°. As such, a feed network for forming beam 1 and beam 2 and the elements 122, 124, 126, and 128 may be reusable. The co-polarization isolation effect of the formed dual-beam is not ideal. Moreover, the formed beam directivity of the dual-beam antenna is not stable.

According to the existing technology, the inventors of the present disclosure think of designing feed networks and elements for forming beam 1 and beam 2 separately to cause the co-polarization isolation of the formed dual-beam to be more ideal and the formed beam directivity of the dual-beam antenna to be more stable.

Figure 2A:
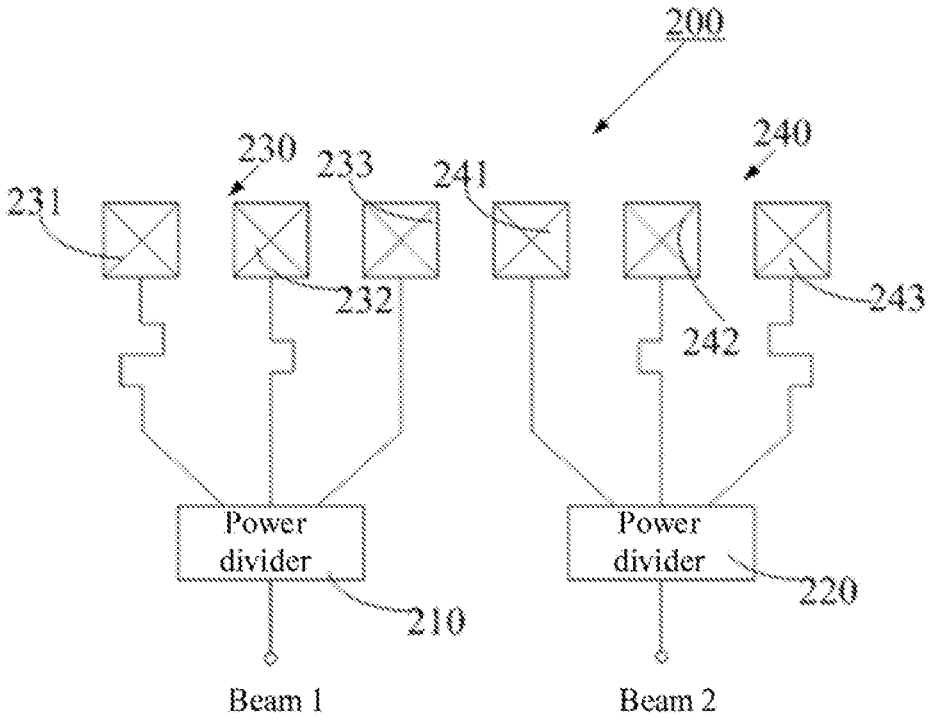
FIG. 2A is a schematic diagram of a dual-beam antenna 200 according to some embodiments of the present disclosure.

FIG. 2A is a schematic diagram of a dual-beam antenna 200 according to some embodiments of the present disclosure. As shown in FIG. 2A, feed networks and elements for forming beam 1 and beam 2 are separate from each other.

In general, the dual-beam antenna 200 shown in FIG. 2A includes an element array and a feed network electrically connected to the element array. In some embodiments, the element array includes a first element set 230 and a second element set 240. The first element set 230 includes at least three first elements 231, 232, and 233 arranged in a row. The second element set 240 includes at least three first elements 241, 242, and 243 arranged in a row. Elements in the first element set 230 and the second element set 240 may be independent of each other. The feed network includes a first feed network and a second feed network independent of each other. The first feed network includes a first power divider 210 and a first cable set. The first power divider 210 is electrically connected to each of the first elements 231, 232, and 233 of the first element set 230 through a corresponding first cable set (i.e., cable set between the first power divider 210 and the corresponding first elements 231, 232, and 233). At least one of the first power divider 210 or the first cable set may be configured to adjust phases of a signal for forming a first beam at each of the first elements 231, 232, and 233. The second feed network includes a second power divider 220 and a second cable set. The second power divider 220 is electrically connected to each of the second elements 241, 242, and 243 of the second element set 240 through a corresponding second cable set (i.e., cable set between the second power divider 220 and the corresponding second elements 241, 242, and 243). At least one of the second power divider 220 or the second cable set may be configured to adjust phases of a signal for forming a second beam at each of the second elements 241, 242, and 243.

Thus, in the present disclosure, only one of the first power divider 210 or the first cable set may be used to adjust the phases of the signal for forming the first beam at each of the first elements 231, 232, and 233. Moreover, the first power divider 210 and the first cable set may be used cooperatively to adjust the phases of the signal for forming the first beam at each of the first elements 231, 232, and 233. Similarly, only one of the second power divider 220 or the second cable set may be used to adjust the phases of the signal for forming the second beam at each of the second elements 241, 242, and 243. Moreover, the second power divider 220 and the second cable set may be used cooperatively to adjust the phases of the signal for forming the second beam at each of the second elements 241, 242, and 243. As shown in FIG. 2A, each cable set includes three cables, and those skilled in the art should know that another number of the cables may be included.

Specifically, in an embodiment shown in FIG. 2A, an input of the first power divider 210 may include a signal for forming beam 1, and outputs of the first power divider 210 are connected to three elements 231, 232, and 233 shown in FIG. 2A via three cables of the first cable set with different lengths, respectively. Correspondingly, an input of the second power divider 220 may include a signal for forming beam 2, and outputs of the second power divider 220 are connected to three elements 241, 242, and 243 shown in FIG. 2A via three cables of the second cable set with different lengths, respectively. In some embodiments, since the three cables of each of the cable sets have different lengths, the phases of the electrical signal for forming beam 1 at the three elements may include −2 Δ P, −Δ P, and 0°, and the phases of the electrical signal for forming beam 2 at the three elements may include 0°, −Δ P, and −2 Δ P. As such, the co-polarization isolation effect of the dual-beam formed by the dual-beam antenna 200 may be more ideal, and the formed beam directivity of the dual-beam antenna may be more stable.

Figure 2B:
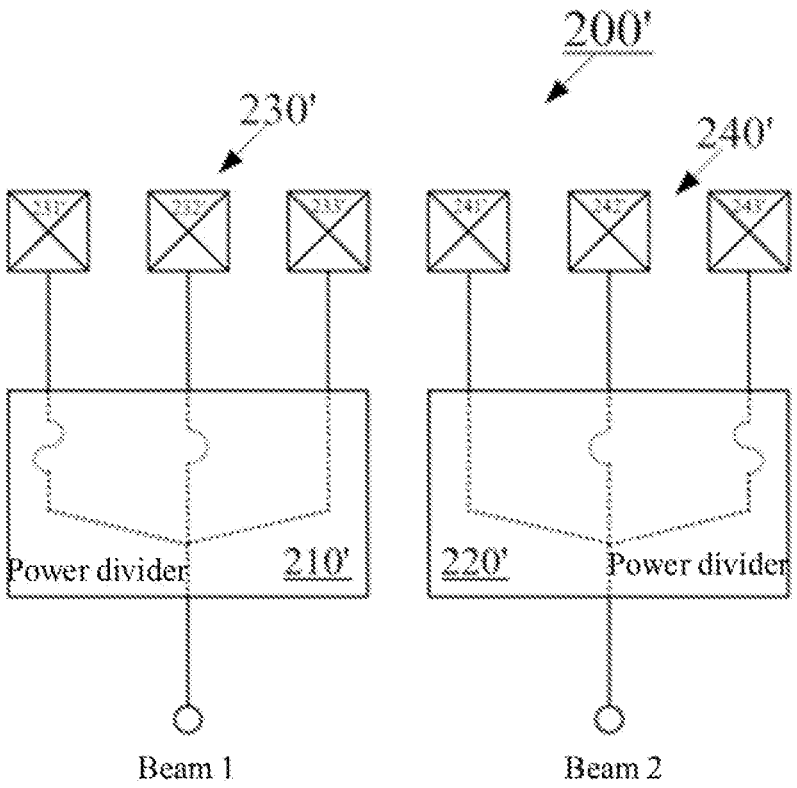
FIG. 2B is a schematic diagram of a dual-beam antenna 200' according to some other embodiments of the present disclosure.

In some other embodiments, FIG. 2B is a schematic diagram of a dual-beam antenna 200' according to some other embodiments of the present disclosure. As shown in FIG. 2B, three cables of a corresponding first cable set have a same length. Correspondingly, three cables of a corresponding second cable set have a same length. In embodiments shown in FIG. 2B, an input of a first power divider 210' includes a signal for forming beam 1. Since wires inside the first power divider 210' that are connected to corresponding output terminals have different lengths (dashed lines shown in FIG. 2B), a phase of a signal at each of the output terminals may satisfy corresponding requirements. Thus, the three cables of the first cable set with the different lengths shown in FIG. 2A are no longer needed, outputs are directly connected to three elements 231', 232', and 233' shown in FIG. 2B via the three cables of the first cable set with the same length shown in FIG. 2B. Correspondingly, an input of a second power divider 220' includes a signal for forming beam 2. Since wires inside the second power divider 220' that are connected to corresponding output terminals have different lengths (dashed lines shown in FIG. 2B), a phase of a signal at each of the output terminals may satisfy corresponding requirements. Thus, the three cables of the second cable set with the different lengths shown in FIG. 2A are no longer needed, outputs are directly connected to three elements 241', 242', and 243' shown in FIG. 2B via the three cables of the second cable set with the same length shown in FIG. 2B.

Figure 2C:
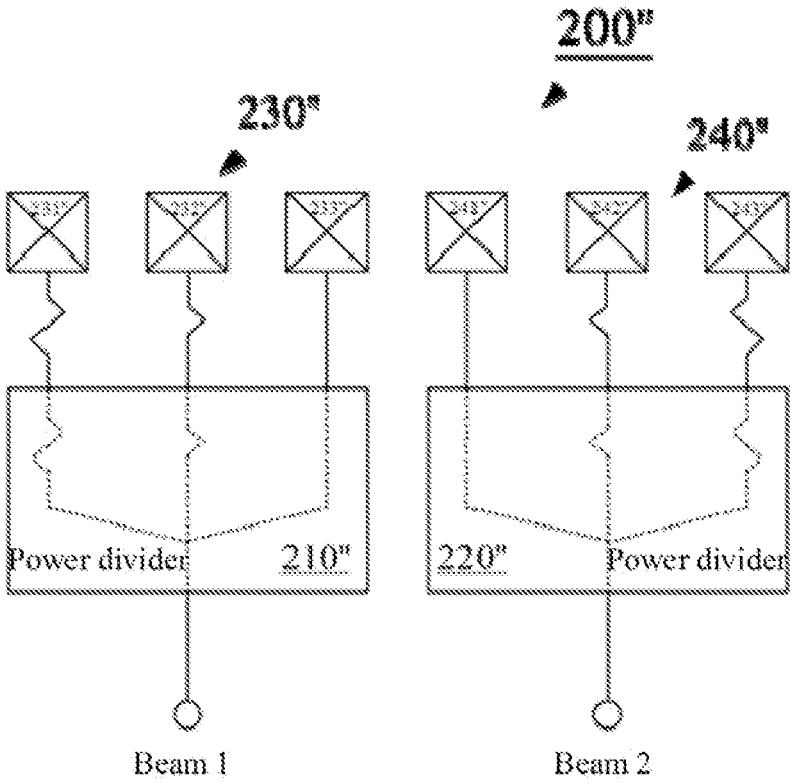
FIG. 2C is a schematic diagram of a dual-beam antenna 200" according to some other embodiments of the present disclosure.

In some other embodiments, FIG. 2C is a schematic diagram of a dual-beam antenna 200" according to some other embodiments of the present disclosure. As shown in FIG. 2C, three cables of a first cable set have different lengths. Correspondingly, three cables of a second cable set have different lengths. However, differences among cables are smaller than differences in FIG. 2A. In embodiments shown in FIG. 2C, an input of a first power divider 210" includes a signal for forming beam 1. Since wires inside the first power divider 210" that are connected to corresponding output terminals have different lengths (dashed lines shown in FIG. 2C), phases of signals at each of the output terminals may be different. Then, the output terminals are connected to three elements 231", 232", and 233" shown in FIG. 2C via three cables of a first cable set shown in FIG. 2C that are shorter than the three cables of the first cable set shown in FIG. 2A. Thus, expected differences in the phases of signals may be realized by using the wires inside the first power divider 210" that are connected to corresponding output terminals and the corresponding three cables of the first cable set that have the different lengths cooperatively. Correspondingly, an input of a second power divider 220" includes a signal for forming beam 2. Since wires inside the second power divider 220" that are connected to the corresponding output terminals have different lengths (dashed lines shown in FIG. 2C), phases of signals at each of the output terminals may be different. Then, the output terminals are connected to three elements 241", 242", and 243" shown in FIG. 2C via three cables of a second cable set shown in FIG. 3C that are shorter than the three cables of the second cable set shown in FIG. 2A. Thus, expected differences in the phases of signals may be realized by using the wires inside the second power divider 210" that are connected to the corresponding output terminals and the corresponding three cables of the second cable set that have the different lengths cooperatively.

Figure 3:
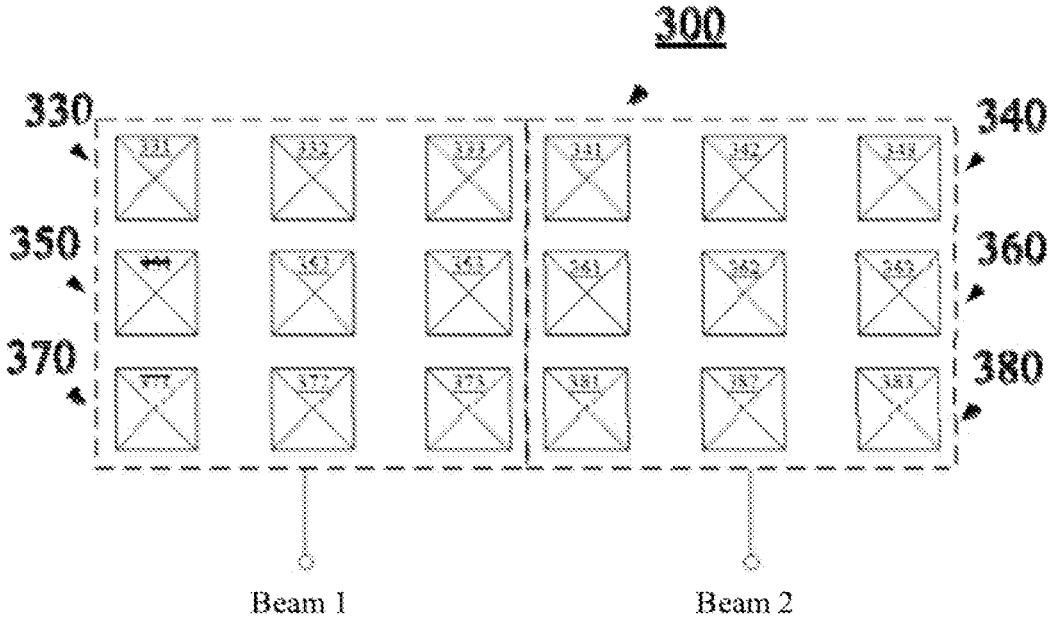
FIG. 3 is a schematic diagram showing an element arrangement of a dual-beam antenna 300 according to some embodiments of the present disclosure.

Based on the dual-beam antennas 200, 200', and 200" shown in FIG. 2A, FIG. 2B, and FIG. 2C, to satisfy requirements of different application scenes for an indication such as an antenna gain, the inventor of the present disclosure thinks of increasing a quantity of the elements of the antenna to cause a dual-beam antenna 300 to satisfy the requirements of different application scenes. FIG. 3 is a schematic diagram showing an element arrangement of the dual-beam antenna 300 according to some embodiments of the present disclosure. As shown in FIG. 3, element arrays for forming the dual-beam of the dual-beam antenna 300 are independent of each other.

In general, the dual-beam antenna 300 may include element arrays and feed networks. Each element array is independent of each other, and each feed network is independent of each other. The element array includes a first element set 330 and a second element set 340. The first element set 330 includes at least three first elements 331, 332, and 333 which are arranged in a row. The second element set 340 includes at least three first elements 341, 342, and 343 which are arranged in a row. The elements of the first element set 330 and the second element set 340 are independent of each other. The first element set 330 and the second element 340 are arranged in a row. The feed network includes a first feed network and a second feed network. The first feed network may include a first power divider (not shown) and a corresponding first cable set. The second feed network may include a second power divider (not shown) and a corresponding second cable set. The first power divider may be electrically connected to each of the first elements 331, 332, and 333 of the first element set 330 through the first cable set. At least one of the first power divider or the first cable set may be configured to adjust phases of a signal for forming a first beam at each of the first elements 331, 332, and 333. The second power divider may be electrically connected to each of the second elements 341, 342, and 343 of the second element set 340 through the second cable set. At least one of the second power divider or the second cable set may be configured to adjust phases of a signal for forming a second beam at each of the second elements 341, 342, and 343. Although not shown, according to the concept of the present disclosure, the first feed network and the second feed network may be independent of each other.

In addition, as shown in FIG. 3, the element arrays of the antenna 300 further include: a third element set 350 including at least three third elements 351, 352, and 353 that are arranged in a row, the quantity of the first elements 331, 332, and 333 being equal to a quantity of the third elements 351, 352, and 353; and a fourth element set 360 including at least three fourth elements 361, 362, and 363 that are arranged in a row, the quantity of the second elements 341, 342, and 343 being equal to a quantity of the fourth elements 361, 362, and 363.

The third element set 350 and the fourth element set 360 are arranged in a row. Each of the third element set 350 and the fourth element set 360 is not arranged in a row with each of the first element set 330 and the second element set 340.

The dual-beam antenna 300 may further include a third feed network and a fourth feed network. The third feed network may include a third power divider (not shown) and a corresponding third cable set. The fourth feed network may include a fourth power divider (not shown) and a corresponding fourth cable set. The third power divider may be electrically connected to each of the third elements 351, 352, and 353 of the third element set 350 through the third cable set. At least one of the third power divider or the third cable set may be configured to adjust phases of a signal for forming a first beam at each of the third elements 351, 352, and 353. The fourth power divider may be electrically connected to each of the fourth elements 361, 362, and 363 of the fourth element set 360 through the fourth cable set. At least one of the fourth power divider or the fourth cable set may be configured to adjust phases of a signal for forming a second beam at each of the fourth elements 361, 362, and 363. Although not shown, according to the concept of the present disclosure, the third feed network and the fourth feed network may be independent of each other.

In addition, as shown in FIG. 3, the element arrays of the antenna 300 further include: a fifth element set 370 including at least three fifth elements 371, 372, and 373 that are arranged in a row, the quantity of the first elements 331, 332, and 333 being equal to a quantity of the fifth elements 371, 372, and 373; and a sixth element set 380 including at least three sixth elements 381, 382, and 383 that are arranged in a row, the quantity of the second elements 341, 342, and 343 being equal to a quantity of the sixth elements 381, 382, and 383.

The fifth element set 370 and the sixth element set 380 are arranged in a row. Each of the fifth element set 370 and the sixth element set 380 is not arranged in a row with each of the third element set 350 and the fourth element set 360. The fifth element set 370 and the sixth element set 380 are arranged in a row. Each of the fifth element set 370 and the sixth element set 380 is not arranged in a row with each of the first element set 330 and the second element set 340.

The dual-beam antenna 300 may further include a fifth feed network and a sixth feed network. The fifth feed network may include a fifth power divider (not shown) and a corresponding fifth cable set. The sixth feed network may include a sixth power divider (not shown) and a corresponding sixth cable set. The fifth power divider may be electrically connected to each of the fifth elements 371, 372, and 373 of the fifth element set 370 through the fifth cable set. At least one of the fifth power divider or the fifth cable set may be configured to adjust phases of a signal for forming a first beam at each of the fifth elements 371, 372, and 373. The sixth power divider may be electrically connected to each of the sixth elements 381, 382, and 383 of the sixth element set 380 through the sixth cable set. At least one of the sixth power divider or the sixth cable set may be configured to adjust phases of a signal for forming a second beam at each of the sixth elements 381, 382, and 383. Although not shown, according to the concept of the present disclosure, the fifth feed network and the sixth feed network may be independent of each other.

In some embodiments of the present disclosure, a phase difference of two neighboring first elements of the first elements 331, 332, and 333 of the first element set 330 may be a first angle. A phase difference of two neighboring second elements of the second elements 341, 342, and 343 of the second element set 340 may be a second angle. A phase difference of two neighboring third elements of the third elements 351, 352, and 353 of the third element set 350 may be a third angle. A phase difference of two neighboring fourth elements of the fourth elements 361, 362, and 363 of the fourth element set 360 may be a fourth angle. In some embodiments, the first angle may be equal to the third angle, and the second angle may be equal to the fourth angle. In some other embodiments, the first angle, the second angle, the third angle, and the fourth angle may be equal to each other. In embodiments of the present disclosure, the lengths of the cables between the first power divider and each of the first elements 331, 332, and 333 of the first element set 330, the structure of the first power divider, and the first angle may be correlated. The lengths of the cables between the second power divider and each of the second elements 341, 342, and 343 of the second element set 340, the structure of the second power divider, and the second angle may be correlated. The lengths of the cables between the third power divider and each of the third elements 351, 352, and 353 of the third element set 350, the structure of the third power divider, and the third angle may be correlated. The lengths of the cables between the fourth power divider and each of the fourth elements 361, 362, and 363 of the fourth element set 360, the structure of the fourth power divider, and the fourth angle may be correlated. In embodiments of the present disclosure, the first angle or the second angle may range from 0° to 150°. In some other embodiments, the first angle or the second angle may be 90°.

Those skilled in the art should know that each element set including three elements is exemplary and not restrictive. As long as the dual-beam is realized, another quantity of elements may be within the scope of the appended claims of the present invention.

Phases of elements in a column may be same, that is, phases of elements in a first column 331, 351, and 371, elements in a second column 332, 352, and 372, and elements in a third column 333, 353, and 373 for forming beam 1 may include −2 Δ P, −Δ P, and 0°, respectively. Phases of elements in a first column 341, 361, and 381, elements in a second column 342, 362, and 382, and elements in a third column 343, 363, and 383 for forming beam 2 may include 0°, −Δ P, and −2 Δ P, respectively.

Figure 4:
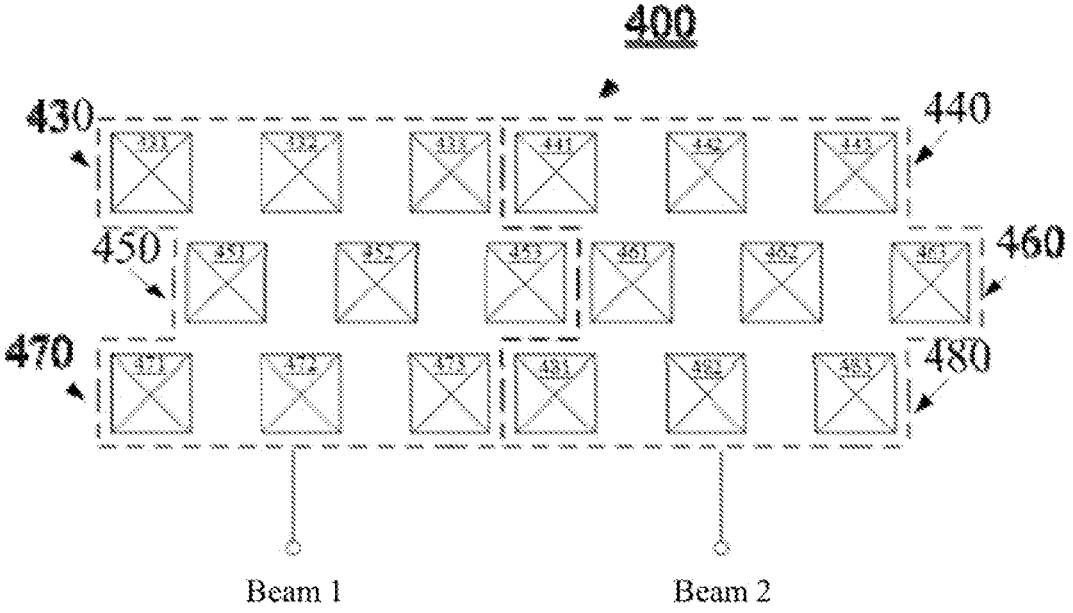
FIG. 4 is a schematic diagram showing an element arrangement of a dual-beam antenna 400 according to some embodiments of the present disclosure.

To further improve the antenna pattern, a height of a grating lobe of a high-frequency point (for example, 2690 MHz) antenna at such as 60° azimuth may be decreased. The grating lobe may take antenna radiation energy, which may not be beneficial for energy concentration and cause a directivity coefficient of the antenna to decrease. The higher the grating lobe is, the more the directivity coefficient decreases. To reduce the impact of the grating lobe for antenna performance, in the present disclosure, corresponding elements in two neighboring rows may be staggered to reduce the height of the grating lobe to increase the antenna gain. FIG. 4 shows an element arrangement after the corresponding elements in the two neighboring rows are staggered. The dual-beam antenna shown in FIG. 4 is significantly improved at the grating lobe around 60° azimuth.

FIG. 4 is a schematic diagram showing the element arrangement of the dual-beam antenna 400 according to some embodiments of the present disclosure. As shown in FIG. 4, the dual-beam antenna 400 includes an element array and a feed network (not shown) electrically connected to the element arrays. The element array includes a first element set 430 and a second element set 440 independent of each other. The first element set 430 includes at least three first elements 431, 432, and 433 which are arranged in a row. The second element set 440 includes at least three first elements 441, 442, and 443 which are arranged in a row. As shown in FIG. 4, the elements of the first element set 430 and the second element set 440 are independent of each other. The first element set 430 and the second element 440 are arranged in a row. The feed network includes a first feed network and a second feed network. The first feed network may include a first power divider (not shown) and a corresponding first cable set. The second feed network may include a second power divider (not shown) and a corresponding second cable set. The first power divider may be electrically connected to each of the first elements 431, 432, and 433 of the first element set 430 through the first cable set. At least one of the first power divider or the first cable set may be configured to adjust phases of a signal for forming a first beam at each of the first elements 431, 432, and 433. The second power divider may be electrically connected to each of the second elements 441, 442, and 443 of the second element set 440 through the second cable set. At least one of the second power divider or the second cable set may be configured to adjust phases of a signal for forming a second beam at each of the second elements 441, 442, and 443. Although not shown, according to the concept of the present disclosure, the first feed network and the second feed network may be independent of each other.

Those skilled in the art should know that each element set including three elements is exemplary and not restrictive. As long as the dual-beam is realized, another quantity of elements may be within the scope of the appended claims of the present invention.

In addition, as shown in FIG. 4, the element arrays of the antenna 400 further include: a third element set 450 including at least three third elements 451, 452, and 453 that are arranged in a row, the quantity of the first elements 431, 432, and 433 being equal to a quantity of the third elements 451, 452, and 453; and a fourth element set 460 including at least three fourth elements 461, 462, and 463 that are arranged in a row, the quantity of the second elements 441, 442, and 443 being equal to a quantity of the fourth elements 461, 462, and 463.

In addition, as shown in FIG. 4, the element arrays of the antenna 400 further include: a fifth element set 470 including at least three fifth elements 471, 472, and 473 that are arranged in a row, the quantity of the first elements 431, 432, and 433 being equal to a quantity of the fifth elements 471, 472, and 473; and a sixth element set 480 including at least three sixth elements 481, 482, and 483 that are arranged in a row, the quantity of the second elements 441, 442, and 443 being equal to a quantity of the sixth elements 481, 482, and 483.

A difference from the dual-beam antenna 300 shown in FIG. 3 includes that the third elements 451, 452, and 453 and the corresponding first elements 431, 432, and 433 are not aligned but staggered in the vertical direction. That is, the third elements 451, 452, and 453 and the corresponding first elements 431, 432, and 433 are staggered in the direction perpendicular to the arrangement direction of the first elements 431, 432, and 433 of the first element set 430. The fourth elements 461, 462, and 463 and the corresponding second elements 441, 442, and 443 are not aligned but staggered in the vertical direction. That is, the fourth elements 461, 462, and 463 and the corresponding second elements 441, 442, and 443 are staggered in the direction perpendicular to the arrangement direction of the second elements 441, 442, and 443 of the second element set 440. Those of skill in the art should know that, for example, the misalignment distance of the first element 431 and the third element 451 may be correlated to the phase difference of the two elements.

Although not shown in FIG. 4, the dual-beam antenna 400 as shown in FIG. 4 further includes a third feed network and a fourth feed network. The third feed network may include a third power divider (not shown) and a corresponding third cable set. The fourth feed network may include a fourth power divider (not shown) and a corresponding fourth cable set. The third power divider may be electrically connected to each of the third elements 451, 452, and 453 of the third element set 450 through the third cable set. At least one of the third power divider or the third cable set may be configured to adjust phases of a signal for forming a first beam at each of the third elements 451, 452, and 453. The fourth power divider may be electrically connected to each of the fourth elements 461, 462, and 463 of the fourth element set 460 through the fourth cable set. At least one of the fourth power divider or the fourth cable set may be configured to adjust phases of a signal for forming a second beam at each of the fourth elements 461, 462, and 463. The third feed network and the fourth feed network may be independent of each other.

As shown in FIG. 4, in embodiments of the present disclosure, each of the first element set 430 and the second element set 440 and each of the third element set 450 and the fourth element set 460 are not arranged in a row. In some embodiments, the first element set 430 and the second element set 440 are arranged in a row. In some embodiments, the third element set 450 and the fourth element set 460 are arranged in a row.

In some other embodiments, a phase difference of two neighboring first elements of the first elements 431, 432, and 433 of the first element set 430 may be a first angle. A phase difference of two neighboring second elements of the second elements 441, 442, and 443 of the second element set 440 may be a second angle. A phase difference of two neighboring third elements of the third elements 451, 452, and 453 of the third element set 450 may be a third angle. A phase difference of two neighboring fourth elements of the fourth elements 461, 462, and 463 of the fourth element set 460 may be a fourth angle. In some embodiments, the first angle may be equal to the third angle, and the second angle may be equal to the fourth angle. In some other embodiments, the first angle, the second angle, the third angle, and the fourth angle may be equal to each other. In embodiments of the present disclosure, the lengths of the cables between the first power divider and each of the first elements 431, 432, and 433 of the first element set 430, the structure of the first power divider, and the first angle may be correlated. The lengths of the cables between the second power divider and each of the second elements 441, 442, and 443 of the second element set 440, the structure of the second power divider, and the second angle may be correlated. The lengths of the cables between the third power divider and each of the third elements 451, 452, and 453 of the third element set 450, the structure of the third power divider, and the third angle may be correlated. The lengths of the cables between the fourth power divider and each of the fourth elements 461, 462, and 463 of the fourth element set 460, the structure of the fourth power divider, and the fourth angle may be correlated. In embodiments of the present disclosure, the first angle or the second angle may range from 0° to 150°. In some other embodiments, the first angle or the second angle may be 90°.

In some embodiments, to reduce, for example, a height of the grating lobe of the high frequency 2690 MHz at such as 60° azimuth, cooperating with the misaligned arrangement setting, a phase setting that matches the arrangement shown in FIG. 4 is summarized by inventors of the present disclosure. In embodiments shown in FIG. 4, the phases of the elements are set as follows.

The phases of the elements 431, 432, and 433, for example, may include −2.5 Δ P, −1.5 Δ P, and −0.5 Δ P. The phases of the elements 441, 442, and 443, for example, may include 0°, −Δ P, and −2 Δ P. The phases of the elements 451, 452, and 453 in the second row may include −2 Δ P, −1 Δ P, and 0°. The phases of the elements 461, 462, and 463, for example, may include −0.5 Δ P, −1.5 Δ P, and −2.5 Δ P. The phases of elements 471, 472, and 473 in the third two, for example, may include −2.5 Δ P, −1.5 Δ P, and −0.5 Δ P. The phases of the elements 481, 482, and 483, for example, may include 0°, −Δ P. and −2 Δ P. Thus, a phase difference between two neighboring elements of the elements in a same row for forming a same beam may be Δ P. A phase difference of corresponding elements of neighboring rows due to the staggering therebetween may need to be set to 0.5 Δ P. As such, the height of the grating lobe of the antenna may be reduced through such a setting, thus the antenna may be impacted positively. The co-polarization isolation of the dual-beam antenna may be significantly decreased from originally about −16 dB, for example, to increase at least above −25 dB, which significantly reduces the interference between left and right beams. In addition, the stability of the beam directivity of the dual-beam antenna may be significantly improved. The beam directivity deviation of the traditional dual-beam antenna is ±3.5°. The beam directivity deviation of the dual-beam antenna of the present disclosure, for example, may be only ±1.5°. The above technical effect is merely exemplary not restrictive. Changes in the structure and changes in the test environment may bring a certain difference.

Those skilled in the art should know that such phase setting is merely exemplary not restrictive, as long as the phase difference between two neighboring elements in a same row for forming the same beam is Δ P. By setting the phase difference between the corresponding elements of the neighboring rows due to the staggering to 0.5 Δ P, the requirement that the phase difference between the two neighboring elements in the same row is Δ P may be satisfied. For example, the phases may also be set as follows. For example, the phases of the elements 431, 432, and 433, for example, may include −2 Δ P, −Δ P, and 0°. The phases of the elements 441, 442, and 443, for example, may include 0°, −Δ P, and −2 Δ P. The phases of the elements 451, 452, and 453 in the second row, for example, may include −1.5 Δ P, −0.5 Δ P, and 0.5 Δ P. The phases of the elements 461, 462, and 463, for example, may include −0.5 Δ P, −1.5 Δ P, and −2.5 Δ P. The phases of the elements 471, 472, and 473 in the third row, for example, may include −2 Δ P, −Δ P, and 0°. The phases of the elements 481, 482, and 483, for example, may include 0°, −Δ P. and −2 Δ P.

Figure 5:
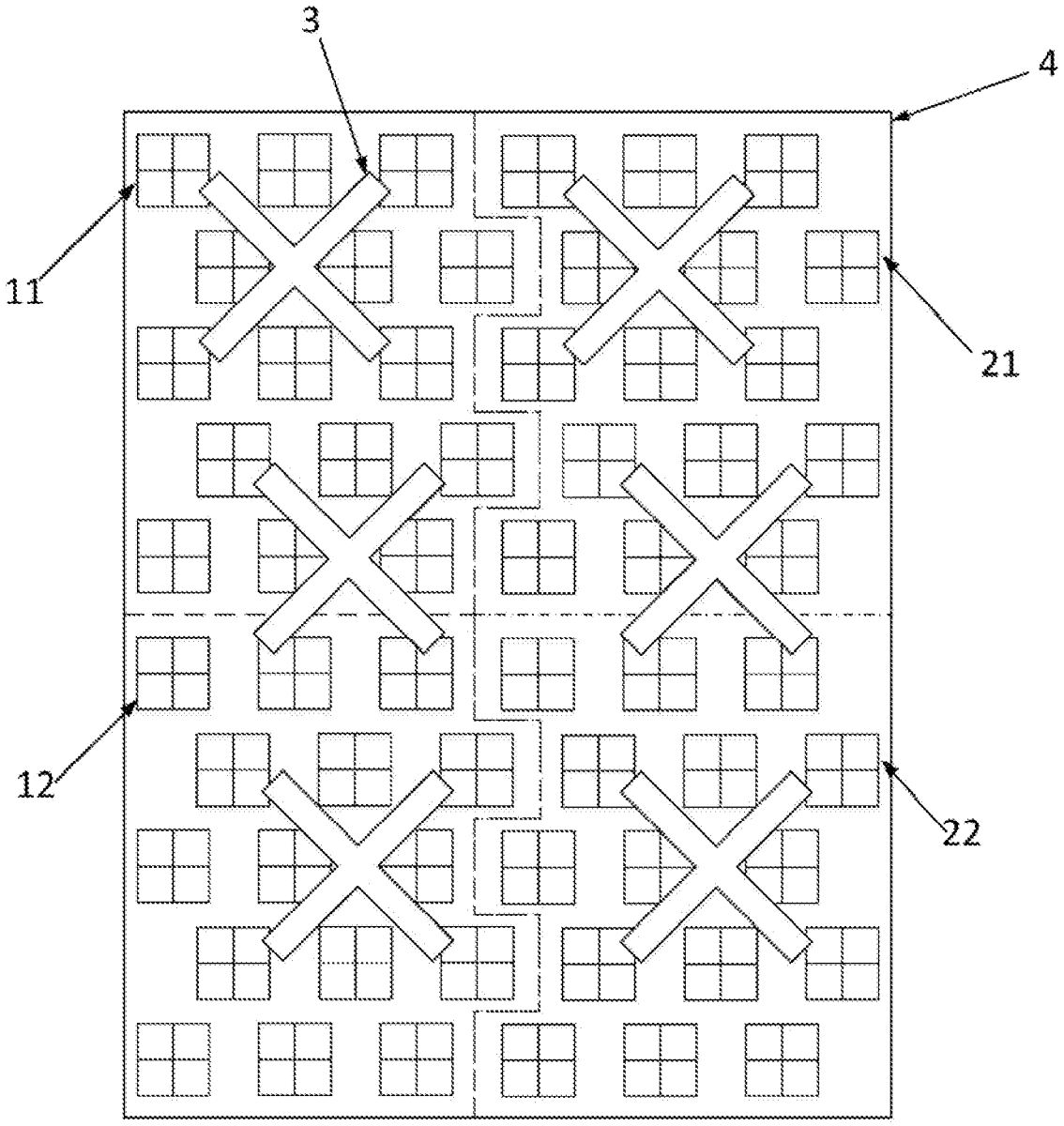
FIG. 5 is a schematic diagram of a hybrid dual-beam antenna 500 according to some embodiments of the present disclosure.

The antennas of FIG. 1 to FIG. 4 may be configured to form the dual beams. The present disclosure further provides a hybrid antenna. The hybrid antenna may include the dual-beam antenna. In addition, the hybrid antenna may further include, for example, a second antenna and a third antenna. The second antenna may include a low-frequency element array. The third antenna may include a high-frequency element array. Thus, the hybrid antenna may include a broader suitable frequency band. The operation frequency band of the second antenna may be lower than the operation frequency band of the dual-beam antenna. FIG. 5 is a schematic diagram of the hybrid antenna 500 according to some embodiments of the present disclosure. A difference between the hybrid antenna 500 and the antenna shown in FIG. 4 includes that on one hand, a quantity of rows of the elements for forming each beam is increased from three to five, and on another hand, a low-frequency element marked with an X-shape sign is added to a gap of the elements. Three low-frequency elements may be arranged to form a low-frequency element array to cause the hybrid antenna to include the dual-beam antenna and the second antenna for radiating a low-frequency signal. In some embodiments, as shown in FIG. 5, the hybrid antenna that includes two low-frequency element arrays and four element arrays of the dual-beam antenna is designed. The hybrid antenna includes a reflection plate 4, two low-frequency element arrays 3 (FIG. 5 shows six low-frequency elements), and four element arrays of the dual-beam antenna. The four element arrays of the dual-beam antenna include array 11, array 21, array 12, and array 22. The array 11 and the array 21 may form a dual-beam antenna. Array 12 and array 22 may form another dual-beam antenna. In some embodiments, array 11 and the corresponding feed network form a beam antenna. Array 21 and the corresponding feed network form another beam antenna. The two beam antennas may eventually form the dual-beam antenna. Array 12 and array 22 may form another dual-beam antenna. Those skilled in the art should know that the six low-frequency elements may be merely exemplary not restrictive, and the four element arrays of the dual-beam antenna may be exemplary not restrictive. For example, more than four element arrays may be included. For example, six element arrays of the dual-beam antenna may be included, or only two element arrays of the dual-beam antenna for may be included.

Figure 6:
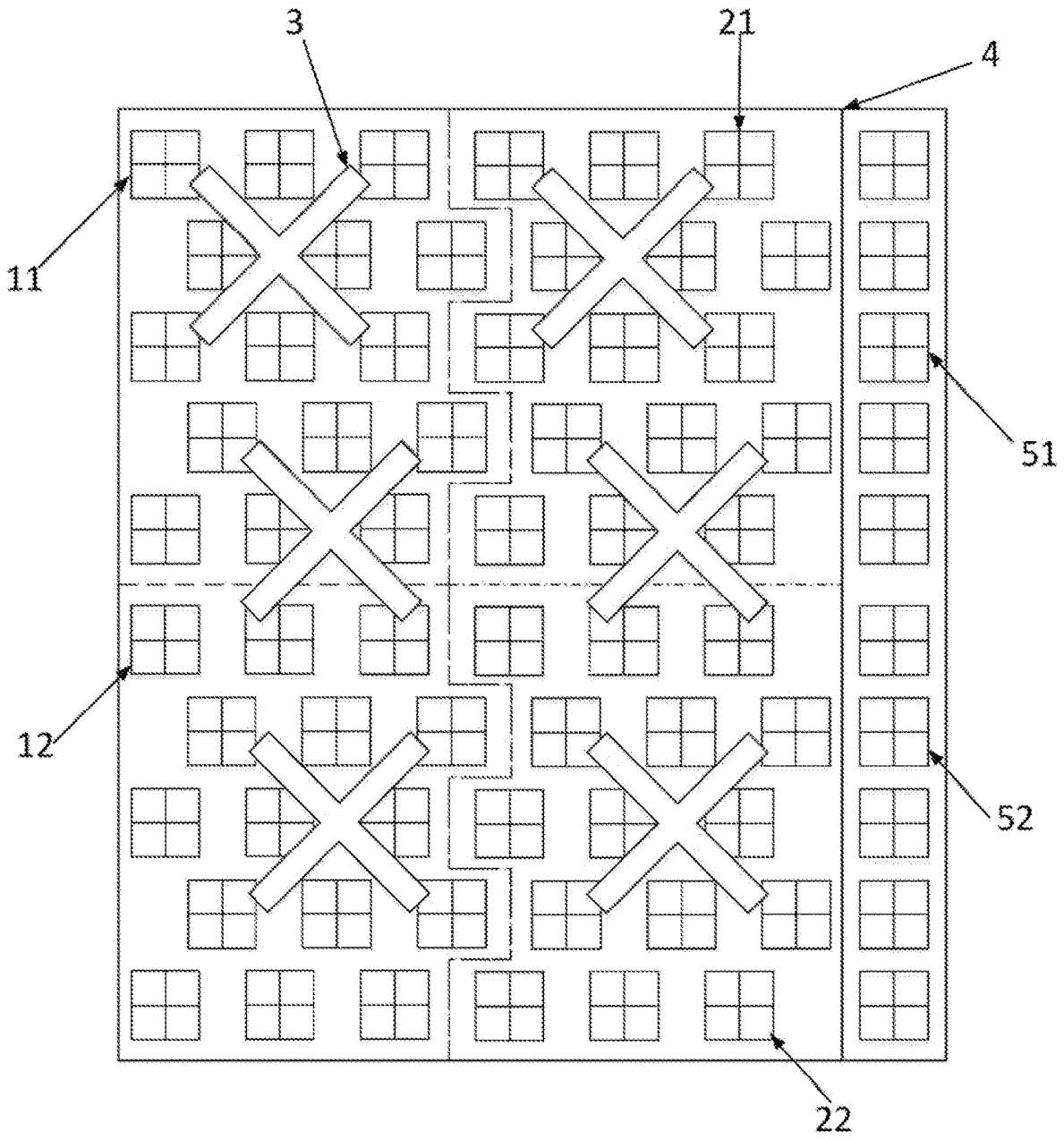
FIG. 6 is a schematic diagram of a hybrid dual-beam antenna 600 according to some embodiments of the present disclosure.

In embodiments of the present disclosure, the hybrid antenna further may include the third antenna. The third antenna may include a high-frequency element array. FIG. 6 is a schematic diagram of a hybrid dual-beam antenna 600 for according to some embodiments of the present disclosure. As shown in FIG. 6, in addition to the elements included in FIG. 5, the hybrid antenna 600 shown in FIG. 6 further includes third antennas 51 and 52. Thus, the hybrid antenna 600 may include two high-frequency element arrays, two low-frequency element arrays, and four element arrays of the dual-beam antenna.

Although different exemplary embodiments of the present disclosure are described, it is obvious to those skilled in the art that various changes and modifications can be made, which can realize one or some advantages of the present disclosure without departing from the spirit and scope of the present disclosure. For those skilled in the art, another component performing the same function may be replaced appropriately. The features explained with reference to a particular accompanying drawing may be combined with features of another accompanying drawing, even in those cases where this is not explicitly mentioned. In addition, the method of the present disclosure can be implemented either in all software implementations using appropriate processor instructions or in a hybrid implementation using a combination of hardware logic and software logic to achieve the same result. Such modifications to the solution according to the present invention are intended to be covered by the appended claims.

What is claimed is:

1. A dual-beam antenna, including:

an element array including:

a first element set including at least three first elements, wherein all elements of the first element set are arranged substantially in a same first row; and a second element set including at least three second elements, wherein all elements of the second element set are arranged substantially in a same second row, and the at least three first elements of the first element set and the at least three second elements of the second element set are independent from each other; and a feed network including:

a first feed network including:

a first cable set; and a first power divider connected to each first element of the first element set through a corresponding first cable in the first cable set, the first cable set and the first power divider being configured to adjust phases of a signal for forming a first beam in the at least three first elements; and a second feed network including:

a second cable set; and a second power divider connected to each second element of the second element set through a corresponding second cable in the second cable set, the second cable set and the second power divider being configured to adjust phases of a signal for forming a second beam in the at least three second elements, wherein a rightmost element of the first element set is arranged on the left of a leftmost element of the second element set.

2. The antenna of claim 1, wherein the element array further includes:

a third element array including at least three third elements arranged substantially in a same row, a quantity of the at least three first elements being equal to a quantity of the three third elements, and each of the at least three third elements being staggered from a corresponding first element; and a fourth element array including at least three fourth elements arranged substantially in a same row, a quantity of the at least three second elements being equal to a quantity of the at least three fourth elements, and each of the at least three fourth elements being staggered from a corresponding second element.

3. The antenna of claim 2, wherein the feed network further includes:

a third feed network including:

a third cable set; and a third power divider connected to each of the three third elements through the corresponding third cable set, the third cable set and/or the third power divider being configured to adjust phases of a signal for forming the first beam in each of the at least three third elements; and a fourth feed network including:

a fourth cable set; and a fourth power divider connected to each of the three fourth elements through the corresponding fourth cable set, at least one of the fourth cable set or the fourth power divider being configured to adjust phases of a signal for forming the second beam in each of the three fourth elements.

4. The antenna of claim 2, wherein a phase difference of corresponding elements of two neighboring rows is correlated to a misalignment distance of the corresponding elements.

5. The antenna of claim 3, wherein each of the first element set and the second element set are not arranged in a row with each of the third element set and the fourth element set.

6. The antenna of claim 3, wherein the third element set and the fourth element set are substantially in a same row.

7. The antenna of claim 3, wherein:

a phase difference of two neighboring third elements is a third angle; and a phase difference of two neighboring fourth elements is a fourth angle.

8. The antenna of claim 7, wherein:

a length of cables of the third cable set and a structure of the third power divider are related to the third angle; and a length of cables of the fourth cable set and a structure of the fourth power divider are related to the fourth angle.

9. The antenna of claim 7, wherein:

a phase difference of two neighboring first elements is a first angle;

a phase difference of two neighboring second elements is a second angle;

the first angle equals to the third angle; and the second angle equals to the fourth angle.

10. The antenna of claim 1, wherein the first row and the second row are the same row.

11. The antenna of claim 1, wherein:

a phase difference of two neighboring first elements is a first angle; and a phase difference of two neighboring second elements is a second angle.

12. The antenna of claim 11, wherein:

a length of cables of the first cable set and a structure of the first power divider are related to the first angle; and a length of cables of the second cable set and a structure of the second power divider are related to the second angle.

13. The antenna of claim 11, wherein the first angle or the second angle ranges from 0° to 150°.

14. The antenna of claim 13, wherein the first angle or the second angle is 90°.

15. A hybrid antenna, including:

a first dual-beam antenna including:

an element array including:

a first element set including at least three first elements, wherein all elements of the first element set are arranged substantially in a same first row; and a second element set including at least three second elements, wherein all elements of the second element set are arranged substantially in a same second row, and the at least three first elements of the first element set and the at least three second elements of the second element set are independent from each other; and a feed network including:

a first feed network including:

a first cable set; and a first power divider connected to each first element of the first element set through a corresponding first cable in the first cable set, the first cable set and the first power divider being configured to adjust phases of a signal for forming a first beam in the at least three first elements; and a second feed network including:

a second cable set; and a second power divider connected to each second element of the second element set through a corresponding second cable in the second cable set, the second cable set and the second power divider being configured to adjust phases of a signal for forming a second beam in the at least three second elements, wherein a rightmost element of the first element set is arranged on the left of a leftmost element of the second element set; and a second antenna including a low-frequency element array and/or a high-frequency element array.

16. The hybrid antenna of claim 15, wherein the element array further includes:

a third element array including at least three third elements arranged substantially in a same row, a quantity of the at least three first elements being equal to a quantity of the three third elements, and each of the at least three third elements being staggered from a corresponding first element; and a fourth element array including at least three fourth elements arranged substantially in a same row, a quantity of the at least three second elements being equal to a quantity of the at least three fourth elements, and each of the at least three fourth elements being staggered from a corresponding second element.

17. The hybrid antenna of claim 16, wherein the feed network further includes:

a third feed network including:

a third cable set; and a third power divider connected to each of the three third elements through the corresponding third cable set, one of the third cable set or the third power divider being configured to adjust phases of a signal for forming the first beam in each of the at least three third elements; and a fourth feed network including:

a fourth cable set; and a fourth power divider connected to each of the three fourth elements through the corresponding fourth cable set, at least one of the fourth cable set or the fourth power divider being configured to adjust phases of a signal for forming the second beam in each of the three fourth elements.

18. The hybrid antenna of claim 17, wherein each of the first element set and the second element set are not arranged in a row with each of the third element set and the fourth element set.

19. The hybrid antenna of claim 15, wherein the first row and the second row are the same row.

20. A hybrid antenna, including:

a first dual-beam antenna including:

an element array including:

a first element set including at least three first elements, wherein all elements of the first element set are arranged substantially in a same first row; and a second element set including at least three second elements, wherein all elements of the second element set are arranged substantially in a same second row, and the at least three first elements of the first element set and the at least three second elements of the second element set are independent from each other; and a feed network including:

a first feed network including:

a first cable set; and a first power divider connected to each first element of the first element set through a corresponding first cable in the first cable set, the first cable set and the first power divider being configured to adjust phases of a signal for forming a first beam in the at least three first elements; and a second feed network including:

a second cable set; and a second power divider connected to each second element of the second element set through a corresponding second cable in the second cable set, the second cable set and the second power divider being configured to adjust phases of a signal for forming a second beam in the at least three second elements, wherein a rightmost element of the first element set is arranged on the left of a leftmost element of the second element set;

a second antenna including a low-frequency element array; and a third antenna including a high-frequency element array.

* * * * *